US006160957A

United States Patent [19]

Johansson

[11] Patent Number: 6,160,957

[45] Date of Patent: Dec. 12, 2000

[54] INFRARED RADIATION PANEL

[75] Inventor: Lars-Göran Johansson, Järfälla, Sweden

[73] Assignee: Kanthal AB, Hallstahammar, Sweden

[21] Appl. No.: 09/355,128

[22] PCT Filed: Jan. 15, 1998

[86] PCT No.: PCT/SE98/00063

§ 371 Date: Jul. 29, 1999

§ 102(e) Date: Jul. 29, 1999

[87] PCT Pub. No.: WO98/33358

PCT Pub. Date: Jul. 30, 1998

[30] Foreign Application Priority Data

Jan. 29, 1997 [SE] Sweden ..... 9700267

[51] Int. Cl.[7] ..... H05B 3/06

[52] U.S. Cl. ..... 392/434; 392/435; 219/536; 338/291; 338/293; 338/306; 338/318

[58] Field of Search ..... 392/434, 433, 392/435–437; 219/213, 532, 536–537, 542, 451.1, 453.11, 461.1; 338/291, 293, 306, 316, 318–319, 315, 283

[56] References Cited

U.S. PATENT DOCUMENTS

| | | | |
|---|---|---|---|
| 1,263,927 | 4/1918 | Rice | 219/532 |
| 1,565,539 | 12/1925 | Woodson | 219/537 |
| 1,677,313 | 7/1928 | Woodson | 338/293 |
| 2,162,030 | 6/1939 | Piazzoli, Jr. | 338/291 |
| 3,036,191 | 5/1962 | Aitken et al. | 392/435 |
| 3,144,545 | 8/1964 | Shrimplin et al. | 219/532 |
| 3,673,387 | 6/1972 | Drugmand et al. | 219/532 |
| 3,818,185 | 6/1974 | Aoki et al. | 219/536 |
| 3,912,905 | 10/1975 | Giler . | |
| 4,262,192 | 4/1981 | Giler | 219/542 |
| 5,029,231 | 7/1991 | Carr et al. | 392/435 |

FOREIGN PATENT DOCUMENTS

| | | | |
|---|---|---|---|
| 86950 | 7/1921 | Austria | 219/532 |
| 579133 | 10/1924 | France | 219/532 |
| 2650774 | 5/1978 | Germany | 219/532 |
| 30209 | 11/1919 | Norway | 219/532 |
| 474934 | 8/1969 | Switzerland | 392/435 |

*Primary Examiner*—John A. Jeffery
*Attorney, Agent, or Firm*—Alfred J. Mangels

[57] ABSTRACT

An infrared radiating panel includes a wall made from ceramic fiber material. An electric heating element is adapted for connection to an electric current source for heating the element to a high temperature at which it will emit infrared radiation is fastened to the wall with the aid of staples. The heating element is mounted in spaced relationship with the surface of the wall and is retained between pairs of ceramic rods that engage opposite faces of the heating element.

11 Claims, 2 Drawing Sheets

INFRARED RADIATION PANEL

BACKGROUND OF THE INVENTION

1. Field of the Invention

The present invention relates to an infrared radiation panel.

2. Description of Related Art

Infrared radiation panels are known in the art and have been supplied by Kanthal AB, Sweden, among others.

Such panels are, in principle, constructed by mounting an electric resistor wire on a wall of ceramic fiber material. The resistor wire is connected to a source of current, so that the wire can be heated to high temperatures, for instance temperatures on the order of 1500–1600° C. The resistor wire then emits infrared radiation.

One problem with these known panels is that the effective life of the resistor wire is not sufficiently long in relation to the desired effective life span of the panel. For instance, in the paper industry, where infrared radiation panels could be used to dry paper and paper pulp, a long effective life span is required because of the continuity of the manufacturing processes involved. For instance, the paper industry desires an effective life span of 16000 hours. Known panels that include a known resistor element and that are marketed by Kanthal AB under the name Kanthal Super 1800 have an effective life span of 6000 hours.

Electric resistor elements of the molybdenum silicide type have long been known. These resistor elements find use primarily in so-called high temperature applications, such as ovens that operate at temperatures of up to about 1700° C.

Swedish Patent Specification 458 646 describes the resistor element Kanthal Super 1900. The material used is an homogenous material with the chemical formula $Mo_xW_{1-x}Si_2$. In the chemical formula, the molybdenum and tungsten are isomorphous and can thus replace one another in the same structure. The material does not consist of a mixture of the materials $MoSi_2$ and $WSi_2$.

$SiO_2$ grows on the surface of the heating element at a parabolic growth rate upon exposure to oxygen at high temperatures, this growth rate being the same irrespective of the cross-sectional dimensions of the heating element. The thickness of the layer may be 0.1 to 0.2 mm after some hundred hours in operation at a temperature of 1850° C. When cooling down to room temperature, this glaze layer will solidify and subject the basic material of the heating element to tension forces owing to the fact that the coefficients of thermal expansion of the basic material differs significantly from that of the glaze. The coefficient of thermal expansion of the glaze is $0.5\times10^{-6}$, whereas the thermal coefficient of expansion of the basic material is $7–8\times10^{-6}$.

These tension forces will, of course, increase with increasing thicknesses of the glaze layer. When the tension forces exceed the mechanical strength of the basic material fractures will occur therein, which takes place when the glaze has grown above a certain critical thickness.

In the case of more slender elements, the proportion of the cross-sectional area constituted by the glaze in relation to the basic material will be larger than in the case of thicker elements. The critical glaze thickness will therefore be reached after a much shorter working time in the case of slender elements than in the case of thicker elements at the same working temperature and under the same operating conditions in general.

It has been believed hitherto that this has been the dominant factor in the effective life span of an infrared radiation panel.

It has been found, however, that the panel construction with respect to the attachment of the resistance wire is highly significant.

The present invention provides an infrared radiation panel whose effective life span is much longer than that of known panels when using the same resistance wire.

SUMMARY OF THE INVENTION

The present invention thus relates to an infrared radiation panel that includes a wall of ceramic fibre material on which an electric resistor element is mounted, and which is adapted for connection to a current source so that the resistor element can be heated to a high temperature at which it emits infrared radiation. The resistor element is attached to the wall with the aid of staples, and is mounted on the surface of said wall in spaced relationship therewith.

BRIEF DESCRIPTION OF THE DRAWINGS

The invention will now be described in more detail with reference to an exemplifying embodiment thereof and also with reference to the accompanying drawings, in which.

DESCRIPTION OF THE PREFERRED EMBODIMENTS

Figure 1:
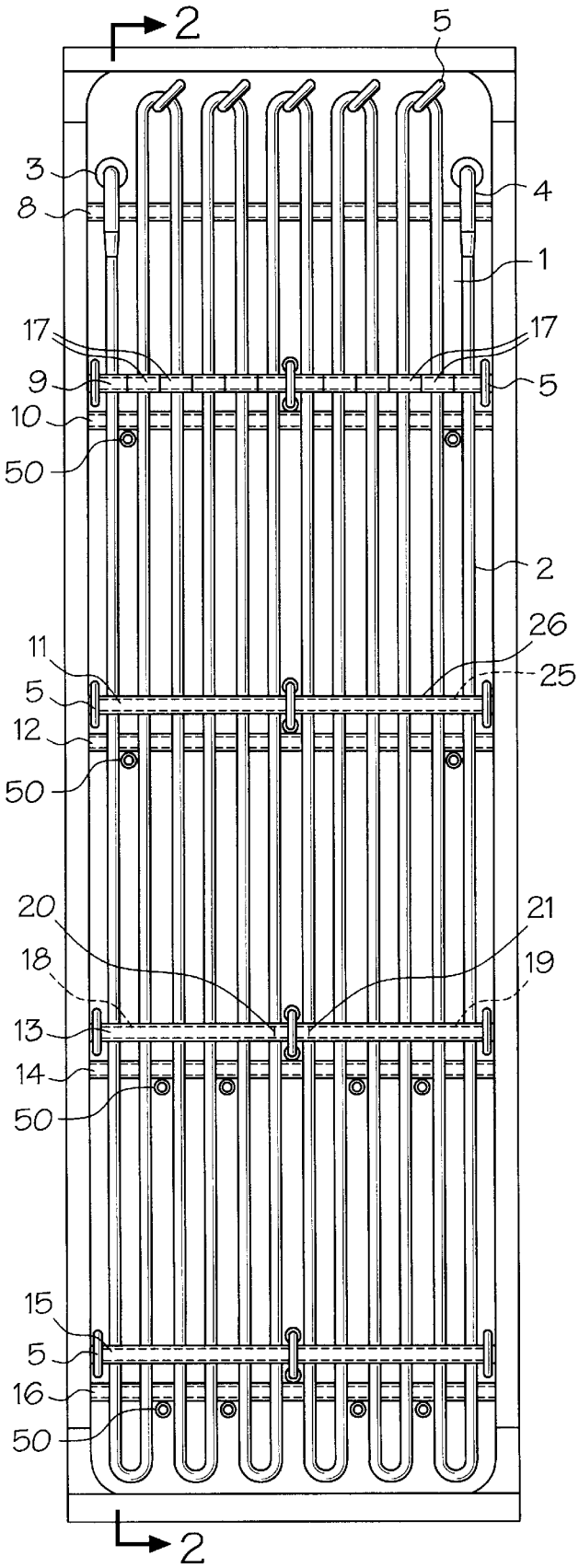
FIG. 1 is a frontal elevational view of an infrared radiation panel.
Figure 2:
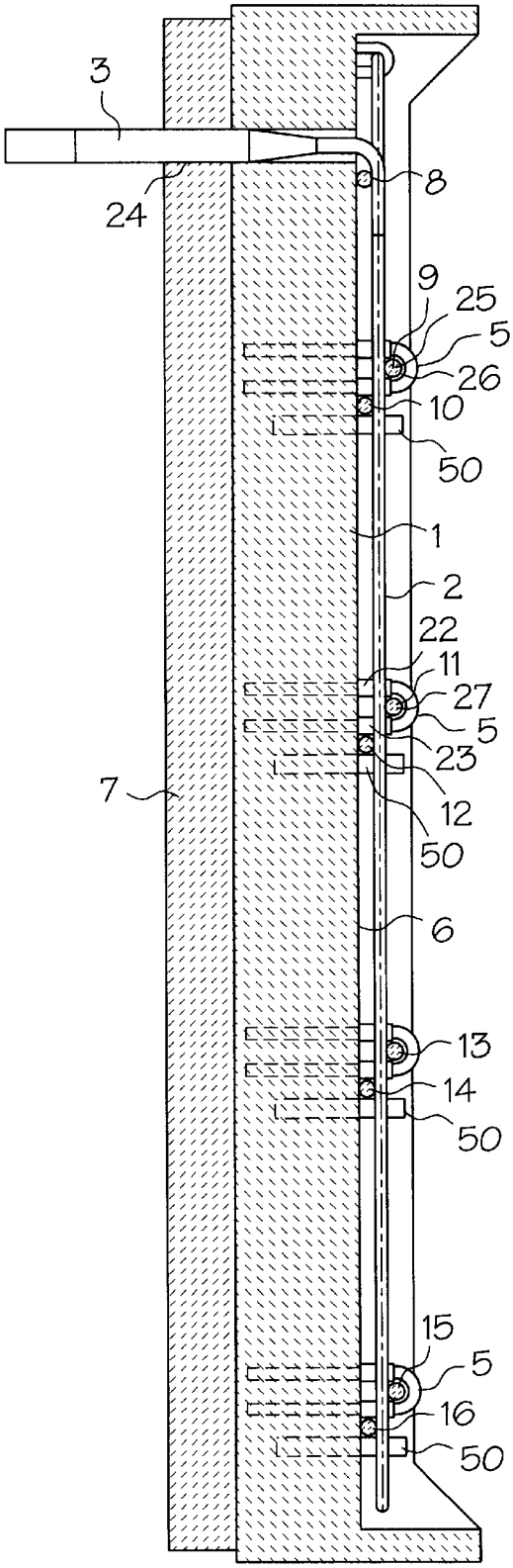
FIG. 2 is a sectional view of the panel taken on the line 2—2 in FIG. 1.

FIGS. 1 and 2 illustrate an infrared radiation panel that includes a wall 1 of ceramic fiber material on which an electric resistor element 2 is mounted. The ceramic fiber material may be an aluminium-silicate type material that includes about 50% $Al_2O_3$. The resistor element is adapted for connection to a source of electric current through the medium of conductors 3, 4, so that the element can be heated to high temperatures at which the resistance wire will emit infrared radiation. The resistance wire is attached to the wall 1 by means of staples 5. The wall 1 is carried by an appropriate material, preferably a sheet 7 whose aluminium oxide content is lower than that of the wall 1.

According to the present invention, the resistor element 2 is mounted on the surface 6 of the wall 1 in spaced relationship therewith. This is a highly significant feature which enables a higher power concentration to be used than that which can be used when the resistor element lies in contact with the wall 1. Because the resistor element is spaced from the wall, the entire outer surface of the element is able to radiate freely. There is also no risk of the element becoming overheated, as in the case when the element 2 is in abutment with the wall 1.

This embodiment obviates the necessity to cool the element 2 or its conductors 3, 4. This feature is highly advantageous and enables the efficiency of the delivered power in relation to the radiation power to be increased by 20–30% in comparison with systems that use halogen lamps.

The energy density in the infrared radiation can be made from two to three times higher than the energy density achieved with known gas radiators. Radiation of shorter wavelengths is also obtained, which makes for more effective drying operations. Infrared radiation with a main peak at a wavelength of 1.5 micrometers and a secondary peak at 2.2 micrometers is typical of a Kanthal resistor element.

The energy density in an inventive panel may reach to 250–340 $kW/m^2$ with an efficiency of above 60% in paper drying. The corresponding energy density of a gas radiator is 90–150 kW/m$^2$ and for an halogen infrared radiator 220–300 kW/m$^2$. A halogen infrared radiator has an efficiency of about 30–40%.

It is therefore evident that the invention reduces the cost of necessary equipment, because no cooling is required and the energy density can be high with high efficiency as a result. It is also evident that an infrared radiation panel according to the invention will have a much better performance than a gas radiator and halogen radiator.

If the resistor element, or heating element 2, is allowed to abut the wall 1, the glaze that forms during operation of the element will fasten to the wall. As the element cools, the glaze will first solidify with the serious risk of the element being pulled away as it shrinks, because the tensile strength of the element is lower than the compression strength of the fiber material in the wall and the adhesion of the glaze to the fiber material.

According to one highly preferred embodiment of the invention, inner ceramic rods 8, 10, 12, 14, 15 are disposed in mutually spaced relationship between the wall surface 6 and the resistor element 2. Mutually spaced outer ceramic rods 9, 11, 13, 15 are disposed on the other side of the resistor element. Inner ceramic rods 10, 12, 14, and 16 each rest on a plurality of support pins 50 that extend outwardly from wall 1.

The ceramic rods 8, 10, 12, 14 and 16 are secured relative to the wall 1 and the ceramic rods 9, 11, 13, and 15 are secured to the resistor element 2 with the aid of staples 5 that engage around respective ceramic rods. The ceramic rods and the staples are referred to hereinafter as support ceramic.

The resistor element 2 is thus held in place between the front and the rear rods and the rods are held in place by the staples.

As a result of this very advantageous design, the resistor element 2 will only be in point contact with the support ceramic, and the surface area over which the glaze adheres to the support ceramic will be so small that the resistor element 2 will be unable to pull apart the solidified glaze as the element shrinks or contracts.

According to one preferred embodiment of the invention, respective ceramic rods on opposite sides of the resistor element 2 or heating resistor, are offset in relation to one another at a location parallel with the surface of said wall, such that when a ceramic rod 10, 12, 14, 16 is present on one side of the heating resistor 2, there will be no rod on the other side of said heating resistor. Such parallel displacement of the ceramic rods 10, 12 and 14, 16 in relation to the rods 9, 11, 13 and 15 is evident from the drawings.

This arrangement avoids so-called hot spots, i.e. points at which the temperature can become higher than the maximum permitted temperature of the resistor element, or heating element, and can result in fractures. Because radiation is solely inhibited on one side of the heating element at a given ceramic rod contact point, the temperature at this location will be lower than if the rods were not offset relative to one another in parallelism.

It is preferred that the ceramic rods 9–16 are comprised of a ceramic tube within which a rod comprised of resistor-element material extends. This provides security against breakdowns as a result of a ceramic rod breaking. The ceramic rods may, alternatively, be comprised of solid ceramic material.

It is also preferred that the ceramic tube accommodating the rods is divided along its length into two or more tubes 17, as illustrated in FIG. 1 with the rod 9. This obviates the risk of the ceramic tube being broken as a result of thermal stresses.

According to one preferred embodiment, the rod-like resistor element that extends within the ceramic rods is divided into two rods 18, 19 which are attached to the wall 1 such that respective free innermost ends 20, 21 of said rod-like resistor elements will not contact one another. This is illustrated in FIG. 1 with the rod 18. This enables a higher maximum electric voltage to be applied over respective rods without the occurrence of creep currents and spark-overs or short-circuiting.

According to another preferred embodiment of the invention, the staples 5 are also made from wire comprised of a resistor-element material. Ceramic tubes 22, 23 are provided outside the wire in at least that region of the staple 5 which comes into contact with the heating element, or resistor element 2. This prevents electric short-circuiting between the legs of the element.

According to one preferred embodiment of the invention, the surfaces of the ceramic rods and the ceramic surfaces of the staples are made from a material that has a high $Al_2O_3$ content. The material will preferably have an $Al_2O_3$-content of about 99% and an $SiO_2$-content of about 1%. It has been found that adhesion between glaze and surfaces of the support ceramic is much lower when the surface material used has a high aluminium oxide content than when having a low aluminium oxide content.

One important feature of the invention is that respective staples 5 will loosely receive the ceramic rods 9–16 supported thereby. This enables the rods to move relative to the staples 5 and also relative to the heating element 2 when the structure moves in response to changes in temperature.

According to one highly preferred embodiment, the heating element 2, or resistor element, is comprised of an homogenous silicide material that contains molybdenum and tungsten and has the chemical formula $Mo_xW_{1-x}Si_2$, where x is between 0.5 and 0.75, and where 10% to 40% of the total weight is at least one of the compounds molybdenum boride or tungsten boride, said compounds existing in particle form in the silicide material.

This material has been found capable of withstanding high temperatures and to give rise to a smaller amount of glaze than earlier elements. The problems associated with element fractures due to adhesion of the glaze to the structure are alleviated when using the aforementioned heating resistor element, while efficiency increases with increasing temperature at the same time.

According to one preferred embodiment of the invention, the heating element conductors 3, 4 are glued in the wall 1, 7, with cement 24 that is capable of adhering to ceramic materials, wherein the conductors pass through the wall in a manner which prevents the conductors from rotating about their own axis relative to the wall. Such rotation would otherwise occur when the heating element reaches its operating temperature. Rotation of the conductors is caused by magnetic fields that are generated around the heating element, where the various legs of the element influence one another.

Although a panel of one particular design has been described in the foregoing, it will be understood by the persons skilled in the art that the concept of the invention can be applied to all infrared radiating panels, irrespective of the shape of the panel and irrespective of how the heating element is bent.

The present invention is therefore not restricted to the aforedescribed and illustrated embodiments thereof, since modifications can be made within the scope of the following claims.

What is claimed is:

1. An infrared radiating panel comprising: a wall panel formed from a ceramic fiber material; an electric heating element adapted for connection to an electric current source for heating the element to a high temperature at which it will emit infrared radiation, said heating element carried by said wall in spaced relationship with a surface of said wall; a plurality of first ceramic rods disposed in mutually spaced relationship between the surface of the wall and the heating element; a plurality of second ceramic rods disposed in mutually spaced relationship against said heating element on a side thereof that faces away from said wall, said second ceramic rods being secured to said wall by a plurality of staples that extend over respective ones of said second ceramic rods and extend into the wall to hold the heating element in spaced relationship with the wall and against and between the first and second ceramic rods.

2. A panel according to claim 1, wherein said ceramic rods have outer surfaces composed of a material having about 99% $Al_2O_3$ and about 1% $SiO_2$.

3. A panel according to claim 1, wherein the ceramic rods on respective sides of the heating element are offset in relation to one another in a direction parallel with said wall surface, so that when one ceramic rod is present on one side of the heating element, no other ceramic rod is present directly opposite an opposite side of said one ceramic element.

4. A panel according to claim 1, wherein the ceramic rods are defined by ceramic tubes which enclose a rod formed from heating element material.

5. A panel according to claim 3, wherein the ceramic tubes include at least two end-to-end ceramic tubes.

6. A panel according to claim 3, wherein the rod of heating element material is divided into two rods supported from said wall such that free ends of said rods are opposite from one another and do not contact one another.

7. A panel according to claim 1, wherein the staples are in the form of a wire of heating element material; and wherein a ceramic tube is provided outside the wire in at least the region of the staple that comes into contact with the heating element.

8. A panel according to claim 1, wherein outer surfaces of respective ceramic rods and ceramic surfaces of respective staples have an $Al_2O_3$ content of about 99%.

9. A panel according to claim 1, wherein the staples loosely receive the ceramic rods to permit the rods to move relative to the staples and relative to the heating element in response to temperature changes.

10. A panel according to claim 1, wherein the heating element is formed from an homogenous silicide material that includes molybdenum and tungsten and has the chemical formula $Mo_xW_{1-x}Si_2$, where x is between 0.5 and 0.75, and where 10% to 40% of the total weight of the heating element is selected from the group consisting of particulate molybdenum boride and particulate tungsten boride.

11. A panel according to claim 1, including conductors connected with the heating element, wherein the conductors are retained in the wall by a ceramic content at that location where the conductors extend into said wall, to prevent rotation of the conductors about their own axis relative to the wall.

* * * * *